United States Patent [19]

Gilbert et al.

[11] 4,275,583

[45] Jun. 30, 1981

[54] BREAKSTEM RIVETING TOOL WITH STEM DISPOSAL DEVICE

[76] Inventors: Terence Gilbert, 17 River View, Welwyn Garden City, Hertfordshire; David J. Sheffield, 66 Varney Rd., Hemel Hempstead, Hertfordshire, both of England

[21] Appl. No.: 84,169

[22] Filed: Oct. 12, 1979

[30] Foreign Application Priority Data

Apr. 20, 1979 [GB] United Kingdom ..... 13881/79

[51] Int. Cl.[3] ..... B21J 15/34

[52] U.S. Cl. ..... 72/391; 72/453.17

[58] Field of Search ..... 72/391, 114, 453.17, 72/453.16, 453.15

[56] References Cited

U.S. PATENT DOCUMENTS

| | | | |
|---|---|---|---|
| 3,363,445 | 1/1968 | Sanders | 72/391 |
| 3,367,166 | 2/1968 | Newton | 72/453.17 |
| 3,415,102 | 12/1968 | Elliott | 72/391 |
| 3,523,441 | 8/1970 | Bell | 72/391 |
| 3,657,915 | 4/1972 | Lee | 72/391 |

*Primary Examiner*—Nicholas P. Godici
*Assistant Examiner*—Gene P. Crosby
*Attorney, Agent, or Firm*—Oblon, Fisher, Spivak, McClelland & Maier

[57] ABSTRACT

A blind riveting tool head for placing blind breakstem rivets is provided with a stem-disposal device which comprises a flexible hose connected to the rear end of a passage running rearwardly through the head from the rivet-placing jaws. An air injector at the junction of the head and the hose supplies both a flow of air rearwardly along the hose to assist broken-off stem portions rearwardly therealong, and also a flow of air forwardly along the passage through the head. When the tool head is operated to place a rivet, both airflows are shut off as the rivet-placing jaws approach their rearmost position, and thereafter the rearward airflow along the hose is re-established before the forwards airflow along the passage.

8 Claims, 3 Drawing Figures

BREAKSTEM RIVETING TOOL WITH STEM DISPOSAL DEVICE

The invention relates to a breakstem riveting tool with a stem disposal device. A breakstem riveting tool operates by first acting on the stem or mandrel of a rivet (e.g. by pulling it or rotating it) thereby to place or install the rivet, and then breaking off a portion of the stem which protrudes from the placed rivet. The broken-off stem portion may then be allowed to drop out of the tool. However, this can easily constitute a hazard, for example by direct impact on the operator of the tool, or by falling on the floor so that the operator or some other person may slip on it (rivet stems are commonly circular in cross-section), or by falling into the work being riveted and causing damage either at that time or later. Consequently it is desirable that broken-off stem portions are disposed of so that they do not constitute such hazards.

Accordingly, it has been proposed to provide a breakstem riveting tool comprising:

a riveting head including gripping means for gripping the stem of a rivet and for acting on it thereby to place the rivet and subsequently to break off a portion of the stem;

a passage leading from the gripping means through the riveting head, through which a broken-off stem portion can pass;

a disposal conduit connected to the other end (i.e. the end remote from the gripping means) of the passage for disposing of a broken-off stem portion which has passed through the passage;

and means for inducing a first stream of air along the disposal conduit in a direction away from its junction with the passage to assist in disposal of a broken-off stem portion thereby, and for inducing a second stream of air along the passage in a direction from the said other end thereof towards the gripping means.

The action of the second or reverse stream of air is to resist the movement of broken-off stem portions along the passage towards the disposal conduit. Each broken-off portion is moved in this direction along the passage by thrust from the next succeeding broken-off portion. Consequently a file or row of broken-off stem portions builds up along the passage, being intermittently pushed rearwardly (i.e. away from the gripping means and towards the disposal conduit). For example, when the riveting head is of the type for placing "pull-to-place" rivets, in which the gripping means act on the rivet to place it by pulling the stem, and the stem of the next rivet is pushed into the front of the riveting head to be engaged by the gripping means, the file or row of broken-off stem portions are moved rearwardly, alternately, firstly by the stroke of the pulling means in pulling the rivet stem to place the rivet and subsequently break the stem and secondly by the insertion of the stem of the next rivet into the pulling means.

In a particular riveting tool head, it may thus be that each broken-off stem portion in turn, when it reaches the junction between the passage and the disposal conduit, is pushed to a position in which one part of its length is under the influence of the first stream of air urging it in one direction whilst another part of its length is under the influence of the second stream of air urging it in the opposite direction. It has been found that these conditions may cause jamming between that stem portion and the one immediately following it (which may have a pointed leading end), possibly due to the said stem portion oscillating, or tilting at an angle.

Accordingly, the invention provides, in one of its aspects, a breakstem riveting tool comprising:

a riveting head including gripping lmeans for gripping the stem of a rivet and for acting on it thereby to place the rivet and subsequently to break off a portion of the stem;

a passage leading from the gripping means through the riveting head, through which a broken-off stem portion can pass;

a disposal conduit connected to the other end (i.e. the end remote from the gripping means) of the passage for disposing of a broken-off stem portion which has passed through the passage;

means for inducing a first stream of air along the disposal conduit in a direction away from its junction with the passage to assist in disposal of a broken-off stem portion thereby, and for inducing a second stream of air along the passage in a direction from the said other end thereof toward the gripping means;

and air stream control means for preventing both air streams from acting on a broken-off stem portion moving from the passage to the disposal conduit and subsequently for allowing the first air stream to act on the broken-off stem portion to urge it along the disposal conduit in a direction away from the junction without allowing the second air stream to act on it.

When the device for inducing the air streams comprises an air injector positioned at the junction of the passage and the disposal conduit and arranged to inject an airflow into the latter in a direction away from the junction, the arrangement being such that the resistance to airflow therethrough provided by the disposal conduit causes the aforesaid second stream of air along the passage in the direction towards the gripping means at least when the magnitude of the injected airflow is sufficiently great, then the air stream control means may comprise means for shutting off the injected airflow for a sufficient time for the air pressure in the conduit to leak away and thereafter re-starting the injected airflow, whereby the re-establishment of the second airflow is delayed until air pressure in the disposal conduit has built up again to provide the aforesaid resistance to airflow therethrough.

It should be noted that references to the disposal conduit in this context of air pressure therein and resistance to airflow therethrough include any stem collecting container to which the disposal conduit may be connected, insofar as the air pressure in or resistance to airflow through the container affect the air pressure in or resistance to airflow through the conduit per se.

When the riveting head is of the type in which the gripping means acts on the rivet to place it by pulling on the stem, so that in the cycle of operation of the tool the gripping means reciprocates, the air stream control means may be arranged to shut off both air streams when the gripping means approaches its rearwardmost position (as hereinbefore defined). This may be achieved by providing valve means connected to the gripping means for reciprocation therewith which valve means shuts off the air injector when the gripping means approaches its rearwardmost position. Conveniently the valve means may be provided by a tube which provides the rearward part of the aforesaid passage. A valve seat may be provided for the valve means, and in a preferred embodiment of the invention the valve seat is provided by the forward end of the disposal conduit. To this end the disposal conduit is preferably resilient, e.g. a hose of synthetic resin material. The rearward part of the tube may fit inside the forward end of the hose.

A specific embodiment of the invention will now be described by way of example and with reference to the accompanying drawings, in which.

The breakstem riveting tool of this example is itself of a well known type, and will be described only in sufficient detail as is necessary for understanding the invention.

Figure 1:
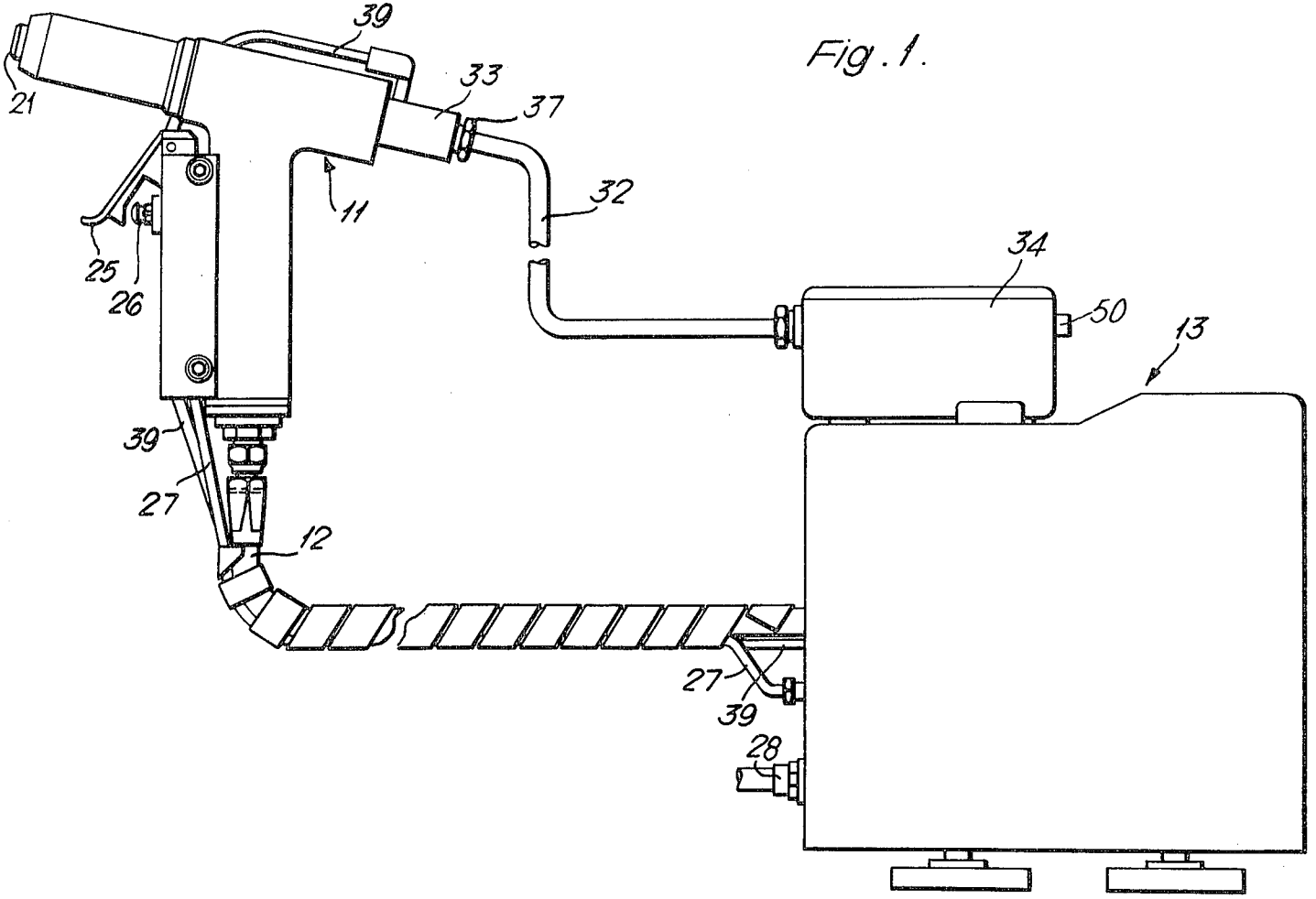
FIG. 1 shows generally the riveting tool and stem disposal device.
Figure 2:
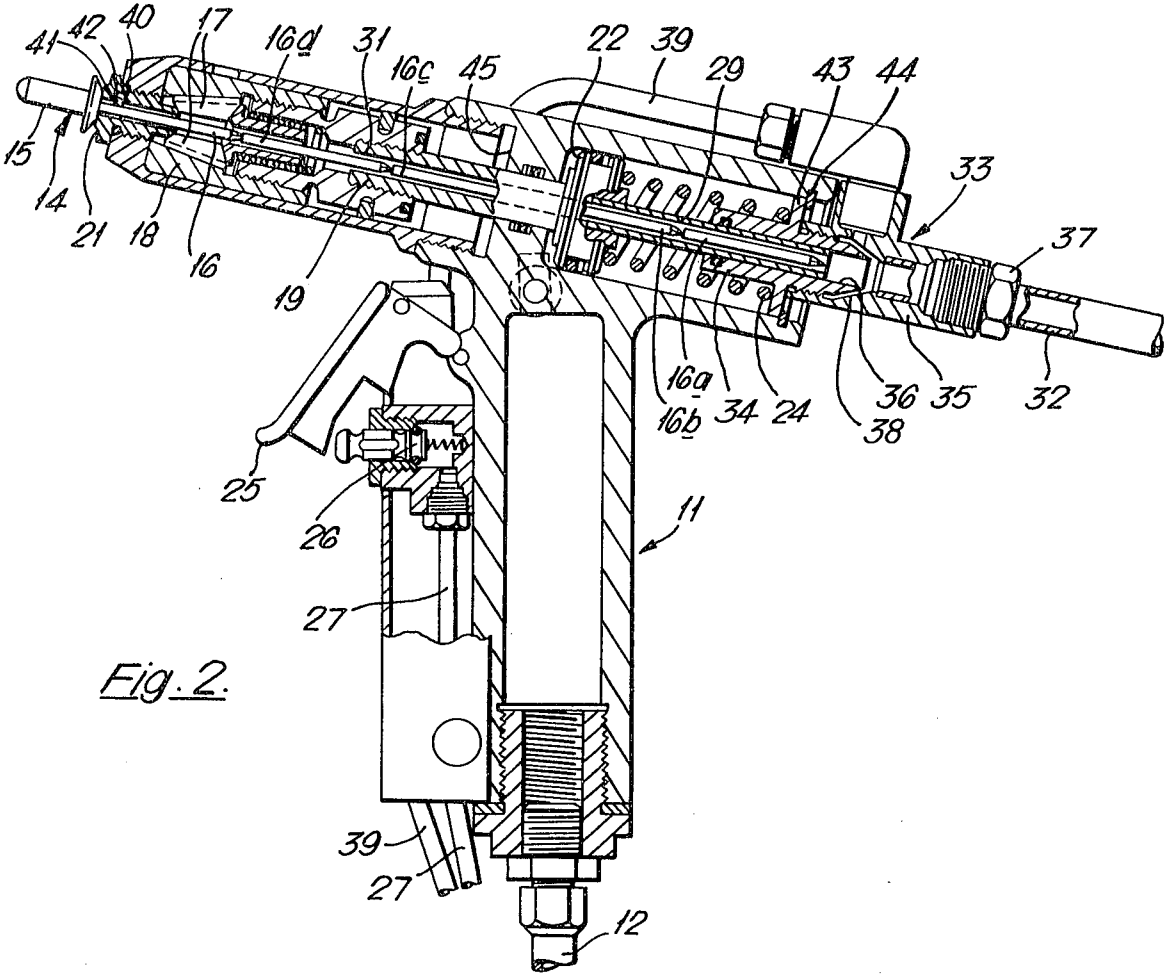
FIG. 2 is a section through the riveting head and air injector device with the gripping means in its forwardmost position.

The riveting tool of this example is hydro-pneumatically powdered and comprises essentially a hydraulically operated riveting head 11 connected by means of a flexible hydraulic hose 12 to a hydro-pneumatic intensifier 13. The riveting tool of this example is intended to place breakstem rivets such as that illustrated at 14 in FIG. 2, for example such as is commercially available under the Registered Trade Mark "AVEX". The rivet comprises essentially a deformable metal shell 15 and a stem 16 which is pulled with respect to the shell in order to expand the shell and place the rivet. The stem is provided with a weakened portion or break-neck at which the protruding part of the stem breaks off. The riveting tool includes a stem gripping means in the form of jaws 17 in a collet 18. The collet is secured to a draw bar 19 and when this is retracted the jaws 17 close on to and grip a rivet stem 16 positioned between them, and pull the stem. The rivet shell 15 meanwhile abuts against a nose-tip or anvil 21, as illustrated in FIG. 2.

The draw bar 19 is connected to a hydraulic head piston 22 sliding in a head cylinder 23, the space of which on the forward side of the piston 22 is connected to the hydraulic hose 12. A return spring 24 is provided behind the head piston 22. The riveting head 11 carries a trigger 25 which actuates a trigger valve 26 which is connected by means of a signal airline 27 to the hydro-pneumatic intensifier 13. Compressed air at line pressure is supplied to the intensifier 13 through an inlet connection 28. When the trigger 25 is depressed by the operator of the tool, the trigger valve 26 alters the air pressure in the signal airline 27 which actuates the intensifer 13 to admit compressed air to the intensifier pneumatic cylinder. This causes hydraulic pressure (substantially greater than the pneumatic airline pressure) to be applied through the hydraulic hose 12 to the riveting head cylinder 23. This forces the piston 22 rearwardly, overcoming the spring 24, thus retracting the collet 18 to pull the rivet stem and place the rivet as previously described.

The portion of the rivet stem gripped by the jaws 17 breaks off after placing of the rivet, and this broken-off stem remains within the collet 18 after the jaws have returned to their forwards position on release of the trigger 25 with consequent removal of the hydraulic pressure and return of the piston 22 under the urging of the spring 24. The riveting tool head is provided with a continuous passage 31 leading from just behind the jaws to the rear of the head, provided (at least along part of its length) by a tube 29 projecting from the rear of the head piston 22. The broken-off stem of one rivet is pushed along this passage alternately by the insertion into the anvil and the jaws of the next and succeeding rivets and by the rearward movement of the jaws in placing succeeding rivets, and this proves is repeated with successive rivets so that a file of stem portions builds up and each broken-off stem portion is eventually pushed throughs the passage to the rear of the head 11. Allowing the broken-off stem to drop out of the riveting head can be dangerous, as previously explained.

The riveting tool of this example is therefore provided with a stem disposal device. This disposal device consists essentially of a disposal conduit provided by a flexible and resilient hose 32 of nylon material connected to the rear end of the passage 31, and means for causing an airflow along the hose 32 in the form of an air injector device 33. In this example, the remote end of the stem collector hose 32 leads into a stem collecting container or canister 34, which in this particular example is conveniently mounted on the hydro-pneumatic intensifier 13.

The air injector device 33 is shown in more detail in FIG. 2. It is mounted on the rear of the tool head 11, and connects one end of the stem disposal hose 32 to the rear end of the stem ejection passage 31. In this particular example it comprises a forwards part 34 and rearwards part 35, the rear part of the forwards part 34 being screwed into the forwards part of the rearwards part 35. A bore 36 extends throughout the whole length of the air injector device. This bore 36 provides the rearmost part of the head passage 31 and receives the rear end of the stem ejector passage tube 29 which reciprocates therein during operation of the tool. The rear part of the bore 36 is connected to the stem disposal hose 32 by means of a coupling 37. The injector device 33 is mounted on the rear end of the tool head 11 by means of a flange 43 on the forwards part 34 which fits into the rear of the bore of the head cylinder 23. The rear end of the head return spring 24 abuts the flange 43 and holds it against a circlip 44 in the rear of the bore. As illustrated in FIG. 2, the rear end of the forwards part 34 and the front end of the rearwards part 35 are both tapered frusto-conically, and they are assembled together with a space between these tapered faces which provides a tapered or frusto-conical port 38 leading rearwardly into the bore 36 at an acute angle. Port 38 is connected to one end of an injector air supply hose 39, the other end of which is supplied with compressed air at line pressure from the air inlet 28 on the pneumatic hydraulic intensifier 13. When compressed air is supplied to the inlet 28, a stream of air is injected continuously into the air injector 33 around the whole of its periphery (unless the injector port is shut off as will be described later) and thus into the stem disposal hose 32 in the direction away from the tool head 11, and blows and broken-off stem entering the hose along the hose towards the collecting container 34. The container 34 is provided with an air vent 50, preferably incorporating a silencer, to allow air to escape to atmosphere so that airflow along the hose 32 is possible.

The resistance to airflow along the stem disposal hose 32 is such that not all of the airflow injected through the port 38 can escape down the hose. Thus there is also created a second airflow, of much smaller magnitude than the airflow along the hose 32, forwardly along the stem ejector passage 31 towards and through the gripping jaws 17. This forwards airflow may be sufficient to tend to eject forwardly a rivet 14 inserted in the nose-tip 21. Consequently, in this particular embodiment, there is provided rivet retaining means. This is provided by a peg 41 riding in an inclined transverse bore 42 in the nose-tip. The peg is urged inwardly by means of a circular spring 40 (which may be a garter spring or a resilient ring such as an o-ring seal) so that it frictionally engages the stem 16 of each rivet inserted in the nose tip, as illustrated in FIG. 2.

Figure 3:
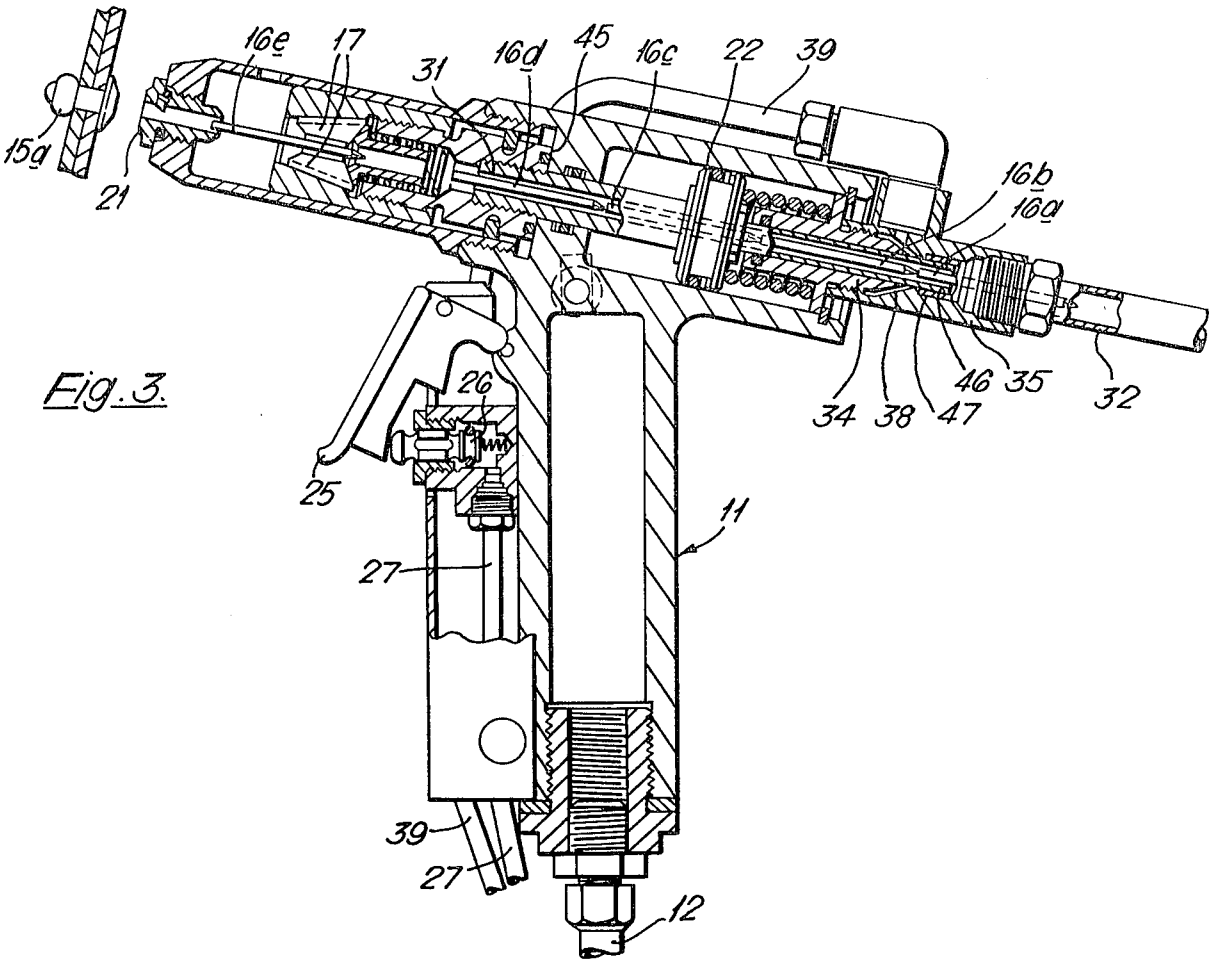
FIG. 3 corresponds to FIG. 2 but shows the gripping means in its rearwardmost position.

When the jaws 17 are in their forwardmost position, they are opened by engagement with the rear end of the nose tip 21, so that the stem of a new rivet can be inserted, as illustrated in FIG. 2. This pushes the broken-off stems 16*a*, 16*b*, 16*c* and 16*d* already in the passage 31 in tube 29 rearwardly. When the rivet 14 is placed, the shell 15 deforms as shown at 15*a* in FIG. 3, and the major portion of the stem 16 is broken off as shown at 16*e* in FIG. 3 while still being 8 ripped by jaws 17. When the stem breaks, the drawber 19 and head piston 22 fly backwards under the hydraulic pressure in cylinder 23, overcoming the weaker return spring 24 until the piston hits a back stop provided by the transverse front wall 45 of the head cylinder 23 as shown in FIG. 3. The inertia of the loose broken-off stem portions 16*a*, 16*b*, 16*c* and 16*d* in the tube 29 carries them on rearwardly a short distance, thus separating the stem 16*d* from the stem 16*e* gripped by the jaws, as shown in FIG. 3.

It will be seen from FIG. 3 that the rearmost end part 46 of the tube 29 acts as a valve member to block off the injector port 38, and in fact it seals in a valve seat provided by the forward end 47 of the resilient disposal hose 32. The effect of this is that, when the rearmost stem portion 16*a* reaches the junction between the passage 31 and disposal conduit 32, where it would otherwise come under the influence of both the rearward air stream along the hose and the forwards air stream along the passage 31, both those air streams are shut off. As previously mentioned, it has been found that a broken-off stem portion which is under the influence of both air streams may exhibit undesired movement, such as oscillating backwards and forwards, or tilting across the passage provided by bore 36 and/or hose bore 32, and this may cause jamming of that portion, maybe together with the next succeeding stem portion.

During the time in which the injector port 38 is thus shut-off, no air flows down the hose 32, and the air pressure in the hose 32 and container 34 decays due to escape through vent 50 and also through the passage 31 and jaws 17.

When the operator releases the trigger 25 and the drawbar 19 moves forwards again, the rearmost part 46 re-opens the port 38, to which compressed air is still being supplied through pipe 39. A strong rearwards airflow is thus re-applied down the disposal hose 32, and it takes a short period of time (say about 0.5 seconds) for the air pressure in the hose and container to build up. During this short period the hose 32 is able to accept all the airflow from the injector port, so there is, for this short period no forwards air stream along the passage 31. (It is not found that stem portions 16*b*, 16*c* and 16*d* are sucked rearwardly at this time). This means that for this short initial period after both air streams have been shut-off, only the rearwards air stream acts on a stem portion, such as 16*a*, which may be positioned with the injector port 38 intermediate its length. With only this rearwards air stream acting on it, the stem portion is removed into the hose 32 before the forwards air stream has time to be established and act on the stem portion. This eliminates the problems referred to previously.

It is not found that stem jamming occurs on rearward movement of the file of broken-off stem portions caused by insertion of a fresh rivet stem into the nosepiece and jaws. Reference to FIG. 2 shows that the now rearwardmost stem portion (16*a*) is still within the tube 29 and has not reached the port 38, whereas the immediately preceding stem portion has previously been removed by the ejector as already described.

The invention is not restricted to the details of the foregoing example. For instance, the shutting-off and re-establishment of the air streams may be achieved in any convenient way, e.g. by the provision of a separate valve controlling the airflow to the injector before it reaches the injector.

What we claim is:

1. A breakstem riveting tool comprising:

a riveting head including gripping means for gripping the stem of a rivet and for acting on it thereby to place the rivet and subsequently to break off a portion of the stem projecting from the placed rivet;

a passage leading from the gripping means through the riveting head, through which a broken-off stem portion can pass;

a disposal conduit connected to the other end of the passage remote from the gripping means for disposal of a broken-off stem portion which has passed through the passage;

means for inducing a first stream of air along the disposal conduit in a direction away from its junction with the passage to assist in disposal of a broken-off stem portion thereby, and for inducing a second stream of air along the passage in a direction from the said other end thereof towards the gripping means;

and air control means for preventing both air streams from acting on a broken-off stem portion moving from the passage to the disposal conduit and subsequently for allowing the first air stream to act on the broken-off stem portion to urge it along the disposal conduit in a direction away from the junction without allowing the second air stream to act on it.

2. A riveting tool as claimed in claim 1, in which the means for inducing the air streams comprises an air injector device positioned at the junction of the passage and the disposal conduit and arranged to inject an airflow into the latter in a direction away from the junction, the arrangement being such that the resistance to airflow therethrough provided by the disposal conduit causes the aforesaid second stream of air along the passage in a direction towards the gripping means, at least when the magnitude of the injected airflow is sufficiently great, and in which the air stream control means comprises means for shutting off the injected airflow for a sufficient time for the air pressure in the conduit to leak away and thereafter re-starting the injected airflow, whereby the re-establishment of the second airflow is delayed until air pressure in the disposal conduit has built up again to provide the aforesaid resistance to airflow therethrough.

3. A riveting tool as claimed in claim 1, in which the riveting head is of the type in which the gripping means acts on the rivet to place it by pulling on the stem, so that in the cycle of operation of the tool the gripping means reciprocates, and in which the air stream control means is arranged to shut off both air streams when the gripping means approaches its rearwardmost position.

4. A riveting tool as claimed in claim 3, including valve means connected to the gripping means for reciprocation therewith which valve means shuts off the air injector when the gripping means approaches its rearwardmost position.

5. A riveting tool as claimed in claim 4, in which the valve means is provided by a tube which provides the rearward part of the aforesaid passage.

6. A riveting tool as claimed in claim 5, in which the valve means includes a valve seat which is provided by the forward end of the disposal conduit.

7. A riveting tool as claimed in claim 6, in which the disposal conduit is resilient.

8. A riveting tool as claimed in claim 6, in which the rearward part of the tube fits inside the forward end of the disposal conduit.

* * * * *

UNITED STATES PATENT AND TRADEMARK OFFICE

CERTIFICATE OF CORRECTION

PATENT NO. : 4,275,583

DATED : June 30, 1981

INVENTOR(S) : Terence Gilbert et al.

It is certified that error appears in the above—identified patent and that said Letters Patent is hereby corrected as shown below:

On the title page, Insert

--(73) Assignee: Aerpat A. G., Zug., Switzerland --.

Signed and Sealed this

*Second* Day of *March 1982*

[SEAL]

*Attest:*

GERALD J. MOSSINGHOFF

*Attesting Officer*

*Commissioner of Patents and Trademarks*